US005360212A

United States Patent [19]

West

[11] Patent Number: 5,360,212

[45] Date of Patent: Nov. 1, 1994

[54] JOINTING JIG

[75] Inventor: Jack West, Aurora, Canada

[73] Assignee: Morgan Moulds, Ltd., Canada

[21] Appl. No.: 81,650

[22] Filed: Jun. 22, 1993

[51] Int. Cl.[5] ..... B25B 1/20

[52] U.S. Cl. ..... 269/40; 269/41; 269/37; 269/901; 269/910

[58] Field of Search ..... 269/37, 40, 41, 43, 269/45, 900, 910, 88, 901

[56] References Cited

U.S. PATENT DOCUMENTS

| | | | |
|---|---|---|---|
| 378,457 | 2/1888 | Oakes | 269/45 |
| 842,007 | 1/1907 | Parker | 269/45 |
| 2,476,721 | 7/1949 | Garner et al. | 269/41 |
| 2,594,052 | 4/1952 | McFerron et al. | 269/45 |
| 3,662,985 | 5/1972 | Parker | 269/40 |
| 4,723,768 | 2/1988 | Waller | 269/41 |
| 5,058,869 | 10/1991 | Ruthven | 269/45 |
| 5,219,153 | 6/1993 | Dietz | 269/40 |

*Primary Examiner*—Robert C. Watson

*Attorney, Agent, or Firm*—Pearne, Gordon, McCoy & Granger

[57] ABSTRACT

A jointing jig for the assembly of two- and three-dimensional joints is disclosed. The jointing jig includes two rigid bodies which are hingedly interconnected. Each rigid body includes a side having a plurality of channels of uniform size designed to accurately locate parallel-sided members for jointing. Each rigid body includes a channel along the hinged side of the body. A rigid removable connector locks the hinged rigid bodies at 90° to each other. This permits the assembly of accurate three-dimensional corner joints. The advantage is that accurate three-dimensional corner joints may be assembled by persons inexperienced in joint construction.

14 Claims, 2 Drawing Sheets

JOINTING JIG

FIELD OF THE INVENTION

The present invention relates to jointing jigs and, in particular, to a novel jointing jig which may be used to assemble accurate three-dimensional corner joints as well as simple and complex two-dimensional joints.

BACKGROUND OF THE INVENTION

Jointing jigs, tools and clamps are widely known and available in a variety of configurations. They are useful for construction and educational purposes. In recent years, there has developed an interest in using jointing jigs to permit students to construct three-dimensional models using preformed uniform frame members as a training exercise for solving structural problems. Modern, quick-setting adhesives have made such exercises practical and promoted interest in them. The construction of rigid structures using preformed members is, however, difficult without a tool to facilitate the assembly of accurate joints between members. Consequently, jointing jigs have been developed to facilitate the assembly of joints that permit the construction of three-dimensional structures.

An example of a jig of this type is described in British patent 2 206 834 B to Hill et al. which was published on May 1, 1991. This patent describes a simple jointing jig of one piece construction comprising a rigid body with no movable parts which is used to locate elongate parallel-sided bodies for the assembly of two-dimensional joints. While the patent teaches the use of the jig for the assembly of three-dimensional joints, the accuracy of such joints is not guaranteed and success in constructing a three-dimensional structure is not ensured.

SUMMARY OF THE INVENTION

It is an object of the invention to provide a jointing jig which permits the assembly of accurate three-dimensional corner joints.

It is a further object of the invention to provide a jointing jig which also permits the assembly of both simple and complex two-dimensional joints.

There is provided in accordance with the invention a jointing jig, comprising:

a pair of hingedly connected rigid bodies, each rigid body being formed with a plurality of channels shaped to respectively accommodate parallel-sided members to be jointed, one said channel being located along a hinged edge of each rigid body, and the channels in each rigid body having a longitudinal axis, the longitudinal axes being coplanar and intersecting, and each channel including means for locating a parallel-sided member received therein so that the parallel-sided member is inhibited from movement in at least two opposite directions normal to the longitudinal axis; and a removable connector means for connecting the rigid bodies so that the rigid bodies are at right angles to each other and the channels along the hinged edge form a socket for receiving a one of the parallel-sided members.

The jointing jig in accordance with the invention provides a tool which is useful in the construction of accurate two- or three-dimensional joints. When locked in a folded condition, it can be used to assemble three-dimensional corner joints. When unfolded, it can be used to assemble a variety of two-dimensional joints.

Although the jig is primarily intended for use in joining members of relatively small cross-section for model building and educational purposes, it is equally adapted to use in heavier constructions.

The jointing jig in accordance with the invention is preferably constructed from a molded plastics material.

BRIEF DESCRIPTION OF THE DRAWINGS

The invention will now be explained by way of example only and with reference to the following drawings wherein.

DETAILED DESCRIPTION OF THE PREFERRED EMBODIMENT

Figure 1:
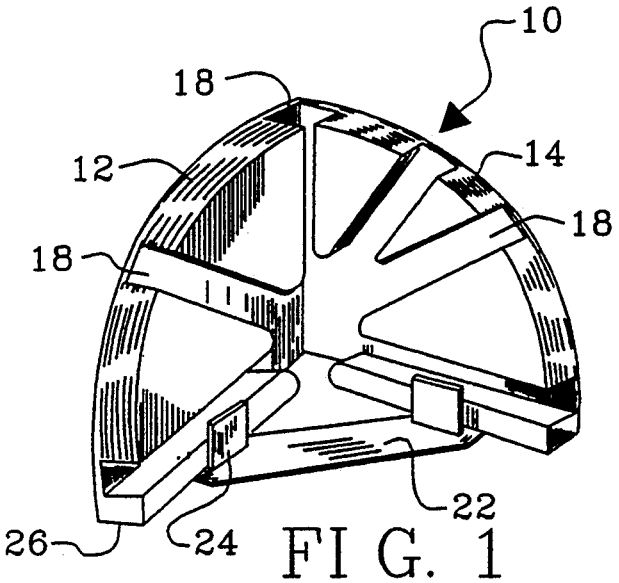
FIG. 1 is a perspective view of the jointing jig in accordance with the invention.

FIG. 1 shows a perspective view of a jointing jig in accordance with the invention, generally indicated by reference 10. The jointing jig includes a pair of hingedly connected rigid bodies 12 and 14. The rigid bodies 12 and 14 are preferably constructed of a plastics material, which may be a sheet material or an injection-molded plastic. The rigid bodies 12, 14 are preferably hingedly connected by a flexible plastic hinge that is well known in the art and commonly referred to as a "live hinge". For jigs intended for heavy use, a mechanical hinge is preferred. Each rigid body includes a plurality of channels 18 which are adapted to accommodate parallel-sided members 20 to be jointed (see FIG. 3). Each channel 18 has a longitudinal axis and all the longitudinal axes of the channels 18 on the respective rigid bodies 12, 14 are coplanar. The members 20 are located for jointing by the channels 18. In the simplest embodiment of the invention, the side walls of the respective channels 18 locate the members 20 and inhibit movement of the members in opposite directions normal to the longitudinal axis of each respective channel 18. Other more sophisticated arrangements can be used to locate members 20 for jointing. For instance, one side wall of each channel 18 can be biased to urge members 20 against the opposite side wall which locates the member for jointing. Members 20 are commonly made from wood and are commercially available at hobby shops and the like.

The rigid bodies 12, 14 may be locked at right angles to each other using a connector 22. The connector 22 is a rigid web that includes a pair of spaced-apart upstanding ribs on each end for engaging opposite sides of a bottom edge 26 of the respective rigid bodies 12, 14. The opposite ends of the connector 22 are oriented at 90° with respect of one to the other, and each pair of upstanding ribs 24 is affixed to the connector 22 in a parallel relationship with the respective opposite ends. In order to ensure accuracy of the relationship between rigid bodies 12, 14, the upstanding ribs 24 located on the opposite ends of connector 22 preferably engage a notch 28 located in the bottom edge 26 of a rear side of each rigid body 12, 14, as shown in FIG. 2.

Figure 3:
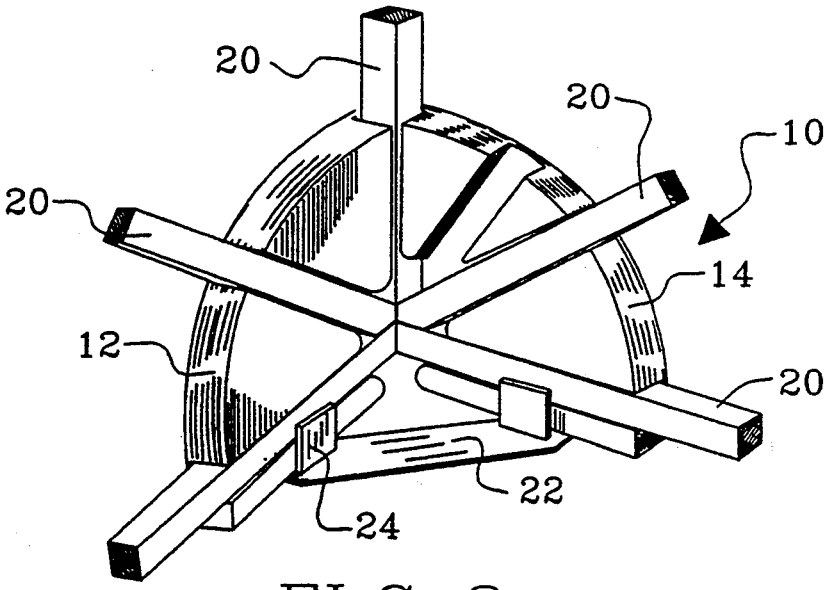
FIG. 3 is a perspective view of the jointing jig shown in FIG. 1, illustrating the use of the jig to assemble a three-dimensional corner joint.

FIG. 3 shows the construction of a three-dimensional corner joint using the jointing jig 10. Five members 20 are used in this example of a three-dimensional corner construction. Accurate corner constructions ensure that three-dimensional models may be successfully assembled. After an adhesive used to connect the members 20 has cured, the connector 22 must be removed and the rigid bodies 12, 14 rotated about the hinge 16 to release the corner construction from the jointing jig 10.

Figure 2:
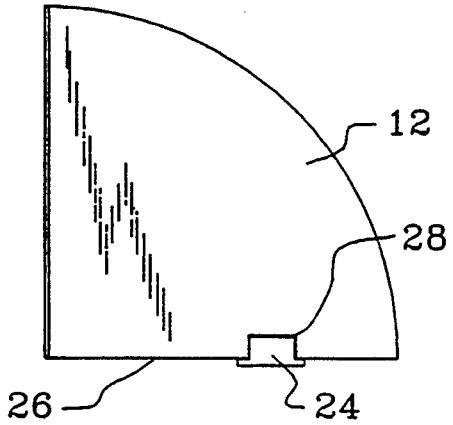
FIG. 2 is a rear side elevational view of the jointing jig shown in FIG. 1.
Figure 4:
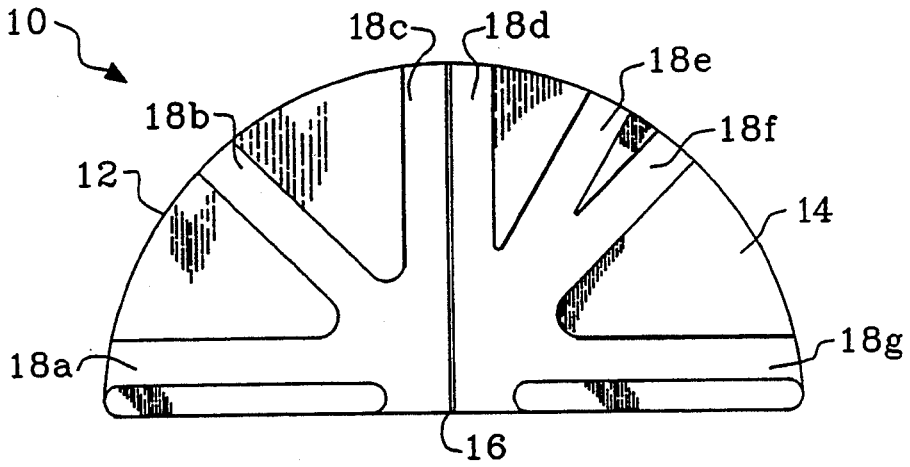
FIG. 4 is a front elevational view of the jig shown in FIG. 1 in an unfolded condition.

FIG. 4 shows a front elevational view of the jointing jig shown in FIGS. 1–3 with the connector 22 removed and the jointing jig in an unfolded, flat condition. This embodiment of the jointing jig 10 includes seven channels 18, indicated by the references 18*a*–18*g*. Channel 18*a* and 18*g* are parallel with the bottom edge 26 of the respective rigid bodies 14, 12, and at 90° to the channels 18*c*, 18*d* located on each side of the hinge 16. Channel 18*b* is oriented at 45° with respect to channel 18*a*, and channel 18*f* is oriented at 45° with respect to channel 18*g*. Channel 18*e* is oriented at 60° with respect to channel 18*g* and 30° with respect to channel 18*d*, and at 120° with respect to channel 18*a*. Other placements of the channels 18 are possible and may be preferred for some applications. The double wide channel 18*c*, 18*d* must always be provided if the jig is to be used for corner constructions which include a vertical member (see FIG. 3).

Figure 5:
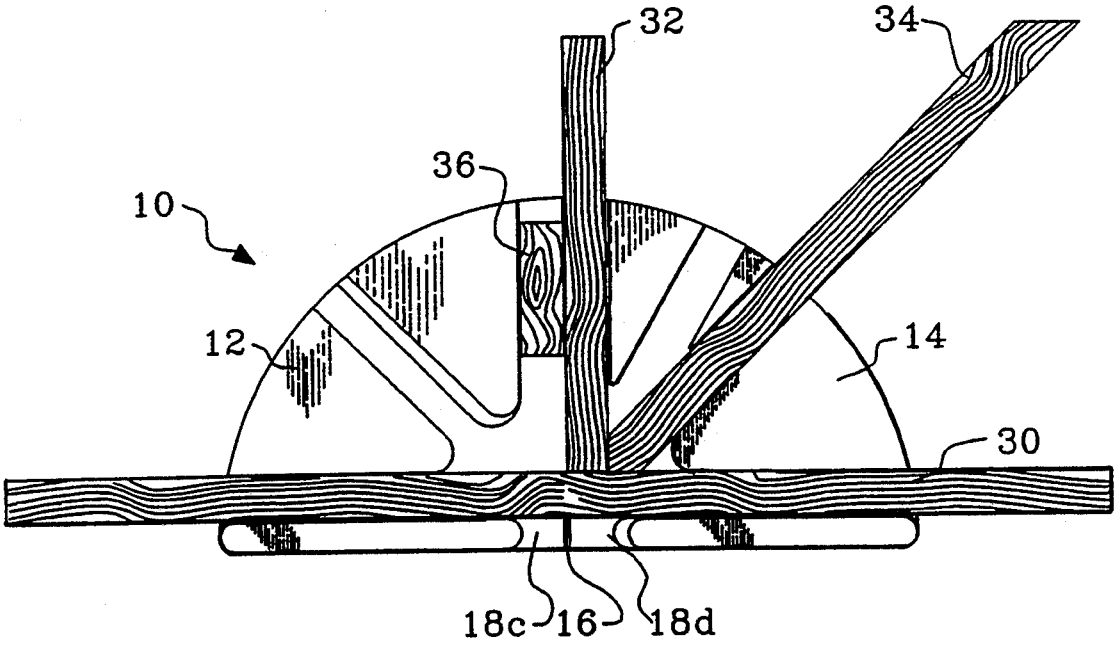
FIG. 5 is a front elevational view of the jig shown in FIG. 4, illustrating one use of the jig to assemble a two-dimensional joint.

FIG. 5 shows a use of the jointing jig 10 in the unfolded condition for constructing a two-dimensional joint in a middle region of a horizontal member 30. In this joint, a vertical member 32 and a diagonal member 34 are joined to the horizontal member 30. When the jointing jig 10 is in the unfolded condition shown in FIG. 5, the channels 18*c* and 18*d* (see FIG. 4) on each side of the hinge 16 form a channel that is twice as wide as the members 20. The position of the vertical member 32 is therefore located using a side wall of the right hand channel 18*d*. Accuracy of the joint may be assured by using a block 36 cut from the same stock as the members 20. Alternatively, the vertical member 32 may be clamped in position using a clamping tool or, if a quick set adhesive is used clamping may not be necessary. Diagonal member 34 is joined at a 45° angle with respect to each of the horizontal member 30 and the vertical member 32.

It will be apparent to those skilled in the art that a variety of other joint configurations can be assembled using the jointing jig 10 in an unfolded condition shown in FIG. 5. The invention therefore provides a very versatile tool which permits the assembly of a variety of accurate joints.

The preferred embodiment of the invention described above is intended to be exemplary only. Changes and modifications to that embodiment may be made without departing from the scope or spirit of the invention.

I claim:

1. A jointing jig, comprising:

a pair of hingedly connected rigid bodies, each rigid body being formed with a plurality of channels shaped to respectively accommodate parallel-sided members to be jointed, one said channel being located along a hinged edge of each rigid body, and the channels in each rigid body having a longitudinal axis, the longitudinal axes being coplanar and intersecting, and each channel including means for locating a parallel-sided member received therein so that the parallel-sided member is inhibited from movement in at least two opposite directions normal to the longitudinal axis; and a removable connector means for connecting the rigid bodies so that the rigid bodies are at right angles to each other and the channels along the hinged edge form a socket for receiving a one of the parallel-sided members.

2. The jointing jig as claimed in claim 1 wherein the means for locating a parallel-sided member received in a channel comprises the side walls of the channel.

3. The jointing jig as claimed in claim 1 wherein the removable connector means comprises a rigid web having opposite ends oriented at 90° with respect of one of the ends to another of the ends, each end including two parallel spaced-apart upstanding ribs that engage opposite sides of each respective rigid body.

4. The jointing jig as claimed in claim 3 wherein a rib that engages a rear side of each respective rigid body fits in a notch in the rigid body to ensure that the rigid bodies are at right angles to each other.

5. The jointing jig as claimed in claim 1 wherein the axis of the channel located along the hinged edge of each rigid body and the axis of another channel in each rigid body are at right angles to each other.

6. The jointing jig as claimed in claim 1 wherein the axis of the channel located along the hinged edge of each rigid body and the axis of another channel in each rigid body are at 45 degrees to each other.

7. The jointing jig as claimed in claim 1, wherein the axis of the channel located along the hinged edge of a one of the rigid bodies and the axis of another channel in the one of the rigid bodies are at 30° degrees to each other.

8. A jointing jig for assembling three-dimensional square corner joints using parallel-sided members, comprising:

a pair of hingedly connected rigid bodies, each rigid body being formed with a plurality of channels shaped to respectively accommodate parallel-sided members to be jointed and one said channel being located along a hinged edge of each rigid body, each channel in a rigid body having a longitudinal axis, the longitudinal axes being coplanar and intersecting, and each channel including means for locating a parallel-sided member received therein so that the parallel-sided member is inhibited from movement in at least two opposite directions normal to the longitudinal axis;

a one of the axes of the channels being normal to the axis of the channel located along the hinged edge of each rigid body; and a removable connector means for interconnecting the rigid bodies so that the rigid bodies are at right angles to each other and the channels along the hinged edge form a socket for receiving a one of the parallel-sided members.

9. A jointing jig as claimed in claim 8 wherein the connector means comprises a rigid flat web having spaced-apart upstanding ribs on each end for engaging opposite sides of a respective bottom edge of each rigid body to retain the hingedly connected bodies at right angles to each other.

10. A jointing jig as claimed in claim 9 wherein the bottom edge of each rigid body includes a notch on at least one side of the rigid body which cooperatively receives a one of the spaced-apart upstanding ribs, whereby the notches locate the web to ensure that the rigid bodies are substantially at right angles to each other.

11. The jointing jig as claimed in claim 1 wherein the rigid bodies are formed from a plastic material.

12. The jointing jig as claimed in claim 11 wherein the hinged edge comprises a live hinge of flexible plastic material.

13. The jointing jig as claimed in claim 8, wherein the rigid bodies are formed from a plastic material.

14. The jointing jig as claimed in claim 13, wherein the hinged edge comprises a live hinge of flexible plastic material.

* * * * *